United States Patent [19]

Vick et al.

[11] Patent Number: 4,539,904

[45] Date of Patent: Sep. 10, 1985

[54] HUSKING MACHINE FOR CEREALS

[75] Inventors: Walter Vick, Hamburg; Rolf Suhrbier, Norderstedt, both of Fed. Rep. of Germany

[73] Assignee: F.H. Schule GmbH, Hamburg, Fed. Rep. of Germany

[21] Appl. No.: 622,682

[22] Filed: Jun. 20, 1984

[30] Foreign Application Priority Data

Jul. 15, 1983 [DE] Fed. Rep. of Germany ... 8320494[U]

[51] Int. Cl.[3] ..... B02B 3/04

[52] U.S. Cl. ..... 99/618; 99/523; 99/621

[58] Field of Search ..... 99/523, 524, 540, 575, 99/574, 579, 585, 618–622, 624, 489, 625, 492, 486, 488; 100/47, 168; 241/37, 232

[56] References Cited

U.S. PATENT DOCUMENTS

| | | | |
|---|---|---|---|
| 4,066,012 | 1/1978 | Satake et al. | 99/618 |
| 4,194,445 | 3/1980 | Gemsjager | 99/621 X |
| 4,295,420 | 10/1981 | Satake et al. | 99/621 X |

FOREIGN PATENT DOCUMENTS

| | | | |
|---|---|---|---|
| 952668 | 3/1964 | United Kingdom | 99/618 |

*Primary Examiner*—Timothy F. Simone

*Attorney, Agent, or Firm*—Handal & Morofsky

[57] ABSTRACT

A husking machine for cereals, with a husking roller mounted in fixed bearings and with a husking roller which is adjustable along an approximately horizontal path and the bearings of which are arranged on a support displaceable on guide members. The support is equipped with linear horizontal guide members, so that the geometric relationships of the roller gap always remain constant. The husking rollers are driven via belt pulleys arranged on their shafts. In the region of the adjustable husking roller, the belt drive is guided in the form of a Z over a fixed belt pulley, then, parallel to the direction of the guide members, to one of the two belt pulleys arranged on the support, from this to the other belt pulley arranged on the support, and finally, parallel to the direction of the guide members, to a belt pulley arranged fixedly. As a result, the belt tension becomes independent of the readjustment of the husking rollers.

2 Claims, 1 Drawing Figure

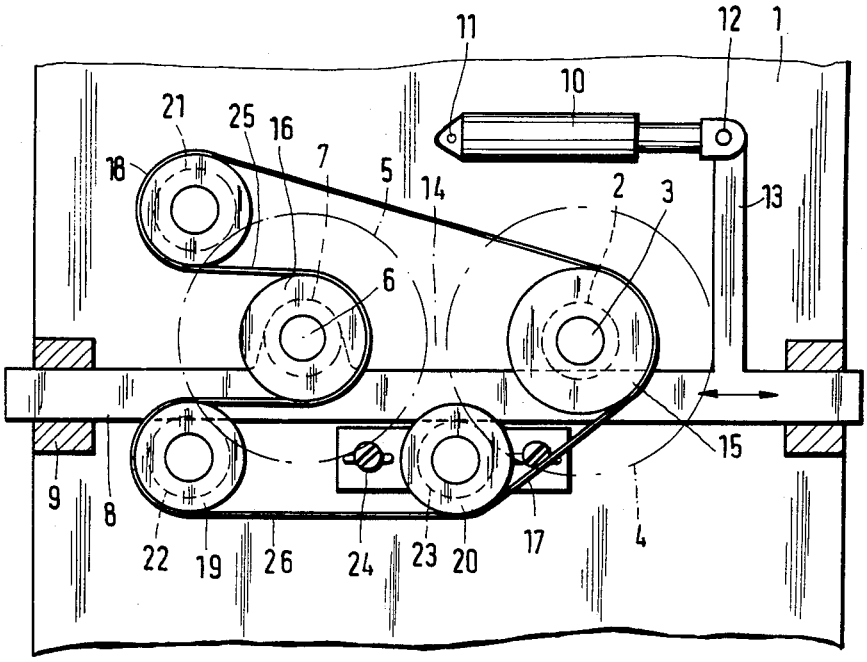
11
12
1
10
21
25
16
7
5
14
2
3
13
18
6
15
9
8
22
19
26
24
23
20
17
4

HUSKING MACHINE FOR CEREALS

DESCRIPTION

The invention relates to a husking machine for cereals, with a husking roller mounted in fixed bearings, with a husking roller which is displaceable along an approximately horizontal path and the bearings of which are arranged on a support displaceable on guide members, and with a belt drive which connects belt pulleys arranged on the two husking-roller shafts via deflecting pulleys, at least one of which is arranged on the support together with the adjustable husking roller.

The husking function of these machines, which are called rubber-roller huskers, is based on the fact that the material to be husked is guided through the roller gap formed between the two husking rollers which rotate at different speeds and the surfaces of which are covered with rubber. During operation, the two rollers are pressed together with a resilient force. Their surfaces undergo wear; consequently, they need to be readjusted relative to one another. For this purpose, one of the two rollers is arranged on the adjustable support and by means of this can be readjusted relative to the other roller mounted fixedly.

In recent rubber-roller husking machines, the support carrying the bearings of the adjustable roller are arranged pivotably. During the adjusting movement, the adjustable roller therefore describes a circular arc. In different positions of adjustment, it has different heights on this circular arc in relation to the fixed roller. The geometrical relationships also change at the roller gap, depending on the state of wear, and this is undesirable for achieving a uniform husking operation. It was thought, however, that these changes could be allowed for, because the influence of the geometrical relationships at the husking gap is less significant than other influencing variables and, as is known, pivoting guidance can be executed in a substantially simpler way than guidance in a straight line, also known from previous times. (DE-A No. 2,612,349; DE-A No. 2,705,334; GB-C No. 797,372; DE-A No. 2,304,704; CH-A No. 396,491; DE-A No. 2,236,676; US-A No. 2,086,659; CH-A No. 119,931).

It is customary to connect the husking rollers to one another by means of a belt drive, a belt being guided over belt pulleys resting on the husking-roller shafts and over deflecting pulleys. Adjustment of the rollers results, in this case, in certain changes in the length of the belt run which make constant retensioning necessary. Special belts resilient in the longitudinal direction can also be used (these being presupposed, for example, in DE-C No. 2,705,334), but they have certain other disadvantages. V-belts are not capable of sufficiently compensating changes in length by means of intrinsic elasticity. The invention has recognised that between the two problem areas discussed, which are completely foreign to one another in functional terms, there is a connection inasmuch as they can both be solved by one and the same means. The essence of the invention is therefore the recognition of the connection between the two problem areas as regards the means of solving them.

According to the invention, in this, the guide members of the support are made linear, and the belt drive is guided, in the region of the adjustable husking roller, in the form of a Z over a fixed belt pulley, then, parallel to the direction of the guide members, to one of the two belt pulleys arranged on the support, from this to the other belt pulley arranged on the support, and finally, parallel to the direction of the guide members, to a belt pulley arranged fixedly.

The invention is explained in more detail below with reference to the drawing which illustrates an exemplary embodiment in a highly diagrammatic side view. The shaft 3 of the fixed husking roller 4, indicated by dot-and-dash lines, is mounted by means of one or more fixed bearings 2 on the plate 1 belonging to the stationary machine frame. The other husking roller 5 has a shaft 6 mounted in the bearing 7 arranged fixedly on a rod 8 which is itself displaceable horizontally in its longitudinal direction in sliding guides 9 fastened to the plate 1. Suitable known devices are provided for displacing it, in the example illustrated a pneumatic cylinder 10 which engages at one end on the plate 1 at 11 and at the other end at 12 on an arm 13 connected firmly to the rod 8. Thus, actuation of the cylinder 10 allows the husking roller 5 to be adjusted horizontally towards the husking roller 4, the geometrical relationships of the roller gap 14 always remaining the same.

Belt pulleys 15, 16 for driving the husking rollers are fastened respectively on the shafts 3, 6 of the husking rollers 4, 5. They are rotated by a belt 17 which is also guided over deflecting rollers 18, 19, 20. The deflecting pulley 18 is mounted in the bearing 21 fixed to the frame. The deflecting pulley 19 is mounted in the bearing 22 rigidly joined to the rod 8. The deflecting pulley 20 is mounted in the bearing 23 which is normally fixed to the frame, but which can be adjusted, for retensioning the belt 17, by means of an arrangement of slots and screws 24.

The belt section 25 running onto the belt pulley 16 from the fixed deflecting pulley 18 is parallel to the guide direction of the rod 8. Also parallel to this is the belt section 26 running between the adjustable deflecting pulley 19 and the deflecting pulley 20 fixed to the frame. When the rod 8 is displaced in one direction or the other, as a result of actuation of the cylinder 10, the belt sections 25 and 26 are lengthened and shortened in opposite directions to one another, so that their changes in length compensate one another exactly. As a result, the total belt length becomes independent of the adjustment of the husking rollers.

What is claimed is:

1. A husking machine for cereals, comprising:

(a) first and second husking rollers both cooperating with each other to produce a husking action, said first and second husking rollers each having a substantially cylindrical wall defining a substantially cylindrical volume;

(b) first and second shaft members concentrically disposed within said substantially cylindrical volume of said first and second husking rollers respectively for supporting said first and second husking rollers respectively;

(c) a machine frame;

(d) a first plurality of fixed bearings for fixably supporting said first shaft to said machine frame;

(e) at least two guide members fastened to said machine frame, at least one of said guide members being in opposing relation with at least one other of said guide members such that said first and second husking rollers are located between said opposing guide members;

(f) a support member slideably engaging said guide members;

(g) a second plurality of fixed bearings for fixably supporting said second shaft to said support member, said second husking roller being slideably adjustable in a path aligned with said first husking roller by means of the slideable action of said support member;

(h) a belt member;

(i) first and second roller pulleys being coaxially disposed and fastened to said first and second shaft members respectively;

(j) a first deflecting pulley fastened to said machine frame and positioned to accept said belt member from said first roller pulley and deliver said belt member to said second roller pulley, said belt member being delivered to said second roller pulley in an orientation parallel to said support member;

(k) a second deflecting pulley fastened to said support member at a point displaced from the fastening point of said second shaft, said second deflecting pulley being positioned to accept said belt member from said second roller pulley, said belt member being guided by said first deflecting pulley, by said second roller pulley, and by said second deflecting pulley through a path substantially similar to a Z shape; and (l) a third deflecting pulley fastened to said machine frame and positioned to accept said belt member from said second deflecting pulley in an orientation parallel to said support member, and also positioned to deliver said belt member to said first roller pulley, said delivery completing a path of said belt member going from said first roller pulley to said first deflecting pulley, then to said second roller pulley, then to said second deflecting pulley, then to said third deflecting pulley, and finally, back to said first roller pulley.

2. A husking machine for cereals, comprising:

(a) first and second husking rollers both cooperating with each other to produce a husking action, said first and second husking rollers each having a substantially cylindrical surface defining a substantially cylindrical volume;

(b) first and second shaft members concentrically disposed within said substantially cylindrical volume of said first and second husking rollers, respectively, for supporting said first and second husking rollers respectively;

(c) a machine frame;

(d) first bearing means for fixedly supporting said first shaft on said machine frame;

(e) guide means fastened to said machine frame for defining opposing guide surfaces;

(f) a support member slideably engaging said guide means for movement along a path;

(g) second bearing means for fixedly supporting said second shaft on said support member, said second husking roller being slideably adjustable in a path aligned with said first husking roller by means of the slideable action of said support member;

(h) a belt member;

(i) first and second roller pulleys coaxially disposed with respect to and fastened to said first and second shaft members, respectively;

(j) a first deflecting pulley fastened to said machine frame and positioned to accept said belt member from said first roller pulley and deliver said belt member to said second roller pulley, said belt member being delivered to said second roller pulley with an orientation parallel to said support member path;

(k) a second deflecting pulley fastened to said support member at a point displaced from the fastening point of said second shaft, said second deflecting pulley being positioned to accept said belt member from said second roller pulley, said belt member being guided by said first deflecting pulley, by said second roller pulley, and by said second deflecting pulley through a path substantially similar to a Z shape; and (l) a third deflecting pulley fastened to said machine frame and positioned to accept said belt member from said second deflecting pulley with an orientation parallel to the path of movement of said support member, and also positioned to deliver said belt member to said first roller pulley, completing a path of said belt member going from said first roller pulley to said first deflecting pulley, then to said second roller pulley, then to said second deflecting pulley, then to said third deflecting pulley, and finally, back to said first roller pulley.

* * * * *